United States Patent [19]

Fanning

[11] Patent Number: 4,752,976

[45] Date of Patent: Jun. 28, 1988

[54] SOFA SLEEPER HAVING IMPROVED MATTRESS SUPPORTING SURFACE

[75] Inventor: Richard P. Fanning, Carthage, Mo.

[73] Assignee: Leggett & Platt, Incorporated, Carthage, Mo.

[21] Appl. No.: 878,140

[22] Filed: Jun. 25, 1986

[51] Int. Cl.[4] ..... A47C 17/04; A47C 19/00

[52] U.S. Cl. ..... 5/13; 5/187

[58] Field of Search ..... 5/13, 259 R, 259 B, 5/187, 230; 160/402, 404; 5/28, 29

[56] References Cited

U.S. PATENT DOCUMENTS

| | | | |
|---|---|---|---|
| 1,332,950 | 3/1920 | Okun | 5/187 X |
| 1,457,232 | 5/1923 | Sheney | 5/187 |
| 2,474,158 | 6/1949 | Neely | 160/402 X |
| 2,826,245 | 3/1958 | Sellner | 160/404 |
| 3,330,330 | 7/1967 | Sanderson | 160/402 X |
| 3,375,861 | 4/1968 | Marlow | 160/404 X |
| 3,561,519 | 2/1971 | Tawbush | 160/404 X |
| 3,854,153 | 12/1974 | Fadler et al. | 5/13 |
| 4,176,414 | 12/1979 | Wright et al. | 5/13 |
| 4,236,260 | 12/1980 | Mizelle et al. | 5/13 |
| 4,253,205 | 3/1981 | Mikos | 5/13 |
| 4,381,570 | 5/1983 | Schneider | 5/13 |
| 4,494,258 | 1/1985 | Blevins et al. | 5/13 X |

FOREIGN PATENT DOCUMENTS

| | | | |
|---|---|---|---|
| 824712 | 12/1959 | United Kingdom | 160/402 |

*Primary Examiner*—Michael F. Trettel

*Attorney, Agent, or Firm*—Wood, Herron & Evans

[57] ABSTRACT

A foldable sofa sleeper fixture comprises a rectangular metal frame having pivotally interconnected head, body and foot sections. That rectangular metal frame is characterized by side and end frame members and an all cloth deck supported by the frame members. The all cloth deck is made from woven polypropylene fabric material which is connected to the side frame members without any resilient connectors therebetween. This woven polypropylene fabric material is characterized by greater stretchability in the warp direction than prior art woven polypropylene fabric deck materials in order to facilitate this direct connection of the deck to the side rails of the frame without the presence of resilient connectors therebetween.

10 Claims, 4 Drawing Sheets

SOFA SLEEPER HAVING IMPROVED MATTRESS SUPPORTING SURFACE

This invention relates to sofa sleepers and more particularly, to a sofa sleeper of the type having an all cloth deck.

Sofa sleepers are popular items of furniture because they serve the dual function of being usable as either a seating surface in the form of a sofa and as a bed when a fixture contained internally of the sofa is unfolded into a horizontal planar configuration.

Sofa sleepers generally comprise an upholstered wooden frame, internally of which there is mounted a sleeper fixture. This fixture comprises a metal frame foldable into three or four sections so as to be completely contained within the wooden frame or unfoldable into three or four colinearly aligned planar sections having one end attached to the interior of the sofa frame and the other end supported above the floor upon which the wooden frame is resting. This foldable metal frame supports a deck, which in turn supports a mattress when the sofa sleeper is used as a sleeping surface. When the sofa sleeper is used as a seating surface, the fixture frame, as well as the deck supported by the frame and the mattress, are all folded within the three or four-section metal frame and placed on the interior of the wooden frame.

The greatest fault found with sofa sleepers and the primary customer objection to use of them is that they provide a relatively poor sleeping surface. This poor sleeping surface feature is primarily attributable to the mattress supporting deck which tends to sag when a person is sleeping on the unfolded sofa sleeper.

In recent years the quality of that sleeping surface has been markedly improved by the use of woven polypropylene all cloth decks, such as shown in U.S. Pat. No. 4,176,414 and U.S. Pat. No. 4,236,260. Prior to the use of all cloth decks of the type illustrated in the two above-identified patents, it had been prior practice to manufacture the deck of multiple links of wire hooked together to form a wire mesh. That wire mesh deck to a greater degree, and the all cloth deck to a lesser degree, suffer from an inability to support persons sleeping on a mattress atop the deck without those person's bodies sagging in the middle and particularly in the area beneath the buttocks.

It has therefore been a primary objective of this invention to provide a foldable sofa sleeper fixture having a deck mounted thereon which is not subject to sag to the extent characteristic of prior art sofa sleepers and particularly to the extent characteristic of prior art all cloth deck sofa sleepers of the type illustrated and described in the two above-identified patents.

Still another objective of this invention has been to provide an improved deck for a sofa sleeper which is not subject to appreciable sag when a person sleeps atop the unfolded deck of the sleeper.

The cloth decks described in the two above-identified patents are manufactured from woven polypropylene fabric. In commercial practice woven polypropylene fabric material is manufactured by a process which minimizes the stretch in the fabric. A problem occurs, though, in the attachment of that relatively non-stretchable fabric to a foldable metal frame. The fabric must be taut on the frame without the presence of any sag or wrinkles, but the frame and the fabric deck are subject to manufacturing tolerances. Those tolerances are often on the order of plus or minus one-quarter inch so that cumulative manufacturing tolerances in both the frame and the deck can be as much as one-half inch. To accommodate these manufacturing tolerances while still maintaining a taut, wrinkle-free deck, it has been prior art practice to connect the deck to the foldable frame of the sofa sleeper by means of a plurality of helical springs along the sides and at least one end of the frame. But these springs, to the extent that they are stretchable, contribute to the sag of the deck when a person lies down atop the deck.

The nature of woven polypropylene deck material which makes it particularly desirable for forming a deck surface of a sofa sleeper is the flexibility and relative non-stretchability of the fabric. The woven polypropylene material is manufactured by a process which results in its being substantially non-stretchable except with a very large force and over a long period of time. This characteristic, while desirable once the deck is attached to the frame, inhibits, and as a practical matter, prevents direct attachment of a woven polypropylene fabric deck to the foldable metal frame of a sofa sleeper because of the need to accommodate as much as one-half inch variance in the distance from one frame to another and from one deck to another. If conventional, non-stretchable polypropylene fabric of the type now used in sofa sleeper decks is attempted to be attached directly to the side rails of a sofa sleeper frame, either the material will have substantial sag or wrinkles in the fabric or it will require extraordinary and impractical force to stretch the fabric taut and pull it into contact with the frame.

To eliminate this spring-induced sag, this invention is predicated upon the concept of mounting an all cloth woven polypropylene fabric deck directly to the side rails of the foldable frame of a sofa sleeper without the presence of any springs between the deck and the frame side rails while attaching the head and foot of the deck to the head and foot of the fixture frame by means of a resilient connection, such as helical spring connectors.

To enable the woven polypropylene fabric to be attached directly to the side rails of a foldable sofa sleeper frame without the presence of wrinkles or sag in the fabric and without the presence of springs to take up the manufacturing tolerance-induced gaps between the frame side rails and the fabric, the invention of this application incorporates a fabric deck material which is capable of limited stretch in the transverse direction of the deck so that with a predetermined and acceptable force the deck may be stretched taut by a workman and attached directly to the frame even though there may be as much as one-half inch of gap between the deck and the fabric prior to the manual stretching of the fabric. The woven polypropylene deck material, which facilitates this type of direct attachment is characterized by approximately 0.1 inch of stretch in the warp direction over 10 inches of length of fabric when subjected to a maximum pull of approximately 30 pounds developed over approximately 0.3 seconds. This stretch of the fabric has been found to enable a deck to be manually attached directly to the side rails of a sofa sleeper frame without the presence of springs or some other flexible or resilient connector between the sides of the cloth deck and the fixture side frames. Any greater stretch results in too much sag in the product when it is used to support a person sleeping on the flat unfolded deck, and any less stretchability makes the fabric too difficult to stretch taut and expand over the width of the deck to accommodate as much as one-half inch on each side of the deck.

Woven polypropylene decks prior to this invention were made from a fabric which could be stretched approximately the same distance with the same force but over a much longer period of time. Consequently, a workman might be able to apply a deck made of the old conventional woven polypropylene deck material to a frame, but the application of the deck to the frame required a much longer and impractical period of time if, as is often the case, there is a gap of as much as one-half inch between the side rails and the edge of the deck material; and even if the necessary time was considered to be expendable, stretching the old fabric to this degree required so great an expenditure of energy on the part of the workman making the assembly that he could not be expected to continue to work for a full work shift at this energy expenditure level, again making the application impractical and uneconomical.

In the practice of this invention, the middle or intermediate section of the new stretchable woven polypropylene cloth deck is fixedly attached to the intermediate or body section of the foldable frame by nonyieldable metal clips. The head and foot ends of the deck may, but need not be, fixedly attached to the side rails of those sections of the foldable frame by nonyieldable connectors since sag is not a problem in those sections of the deck. The head and foot ends of the deck, through, must be connected to the head and foot ends of the metal frame by a resilient connector, as for example helical springs, on at least one end and preferably at the foot end so as to accommodate folding of the frame with the mattress contained therein, as well as to accommodate resiliency of the seating surface once the mattress is folded internally of the fixture.

The primary advantage of a sofa sleeper deck made in accordance with this invention is that it enables the deck of a sofa sleeper to be used as a sleeping surface without the characteristic and uncomfortable sag heretofore characteristic of all sofa sleeper decks when used as a sleeping surface.

These and other objects and advantages of this invention will be more readily apparent from the following description of the drawings in which.

Figure 1:
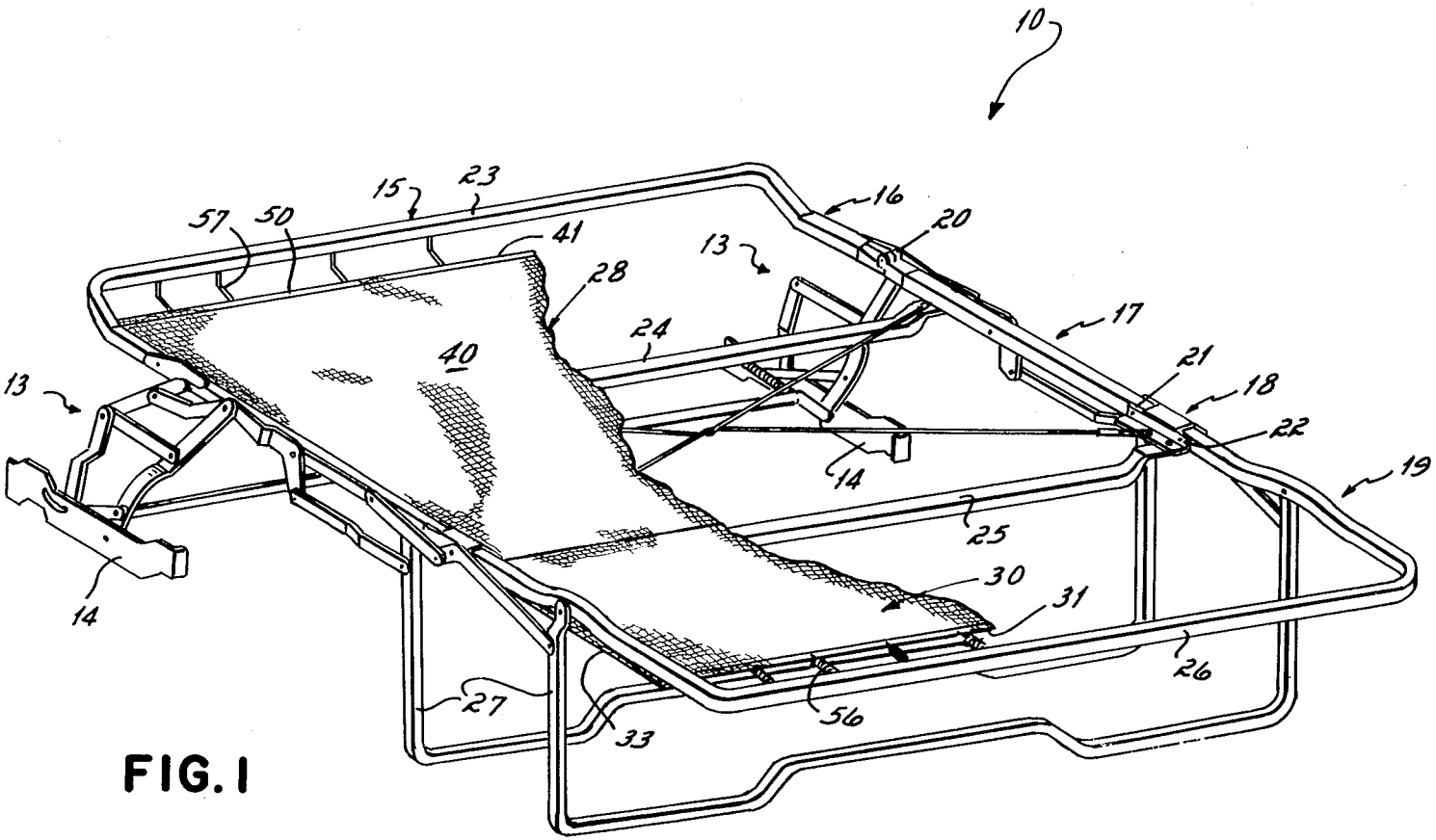
FIG. 1 is a perspective view, partially broken away, of a sofa sleeper incorporating the invention of this application.
Figure 2:
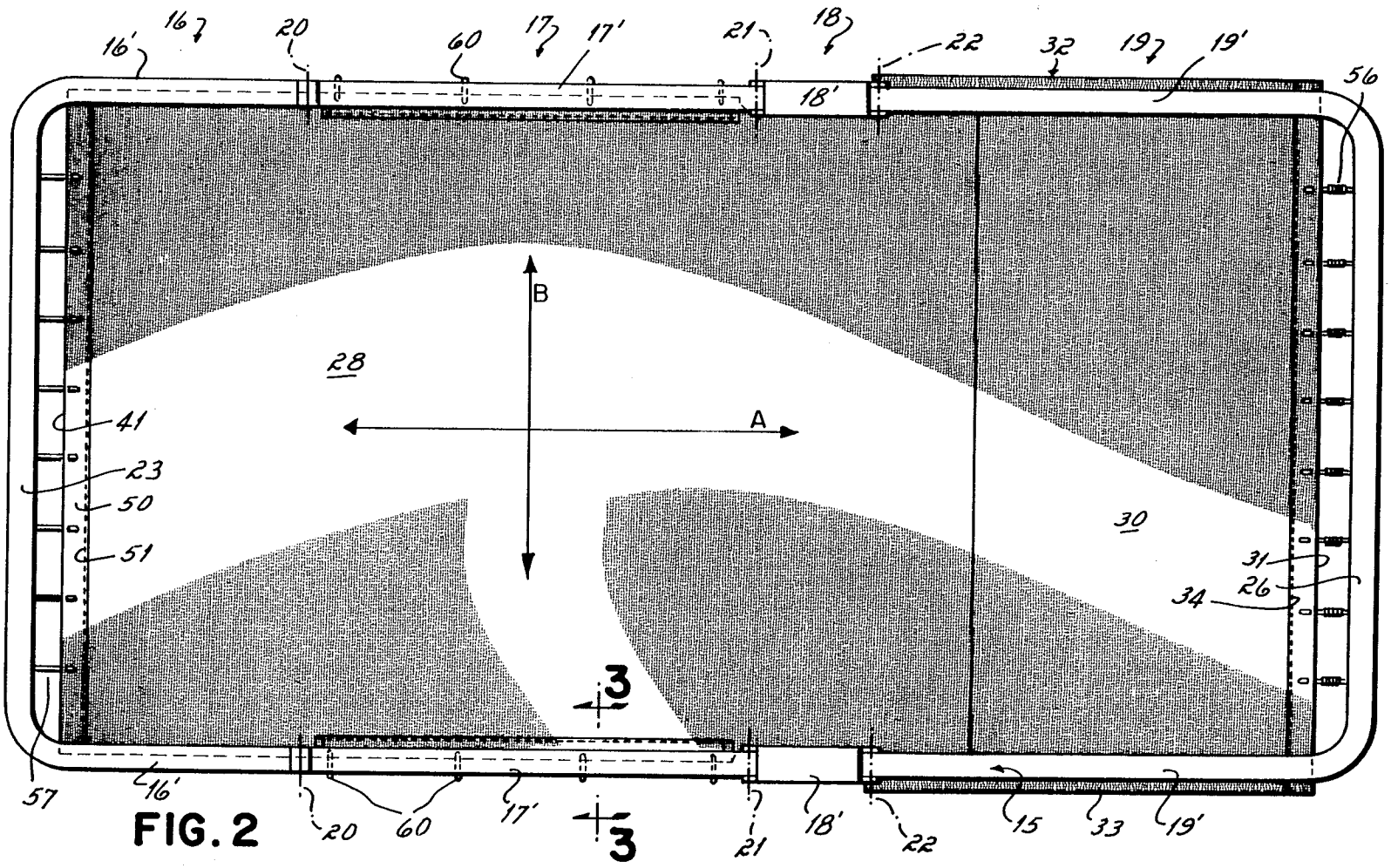
FIG. 2 is a top plan view of the sofa sleeper of FIG. 1.
Figure 3:
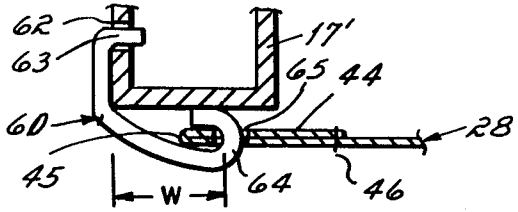
FIG. 3 is a cross-sectional view taken of line 3—3 of FIG. 2 illustrating one of the wire clips securing the cloth deck to the frame.

With reference first to FIGS. 1 and 2, there is illustrated a sofa sleeper fixture 10 which is adapted to be mounted upon a wooden framework (not shown) of an upholstered sofa sleeper. The sofa sleeper conventionally has an upholstered backrest cushion and sofa arms. The wooden sofa framework and upholstered backrest cushion and sofa arms do not form any part of the invention of this application and may comprise any well known standard upholstered construction.

The sofa sleeper fixture 10 comprises a foldable, generally rectangular bed frame 15 attached to the wooden frame of the sofa by linkage structure 13 located on opposite sides of the bed frame 15. This linkage structure includes a pair of base plates 14 fixedly attached to the inside vertical walls of the sofa frame arms and connecting links 13. The linkage structure 13 is conventional and per se forms no part of the invention of this application. It functions to foldably interconnect the foldable bed frame 15 with the wooden sofa frame so as to enable the rectangular bed frame 15 to be folded into an internal cavity of the wooden sofa frame or extended therefrom into the flat planar configuration illustrated in FIGS. 1 and 2. One linkage structure particularly useful with the bed frame 15 is completely described in detail in U.S. Pat. No. 4,253,205, assigned to the assignee of this application. The disclosure of U.S. Pat. No. 4,253,205 is herein incorporated by reference for purposes of completely describing one linkage mechanism suitable for use in the sofa sleeper of this invention.

The foldable bed frame 15 of the fixture 10 includes four pivotally interconnected bed frame sections: a head frame section 16, a body section 17, an intermediate section 18, and a foot section 19. The pivotal connections between these sections are indicated at 20, 21 and 22, respectively.

The foot section 19 of the bed frame 15 is hereinafter referred to as the front deck section of the bed frame, and the head section 16, body 18 and intermediate section 18 of the bed frame are hereinafter referred to collectively as the rear deck section of the bed frame.

Substantially parallel side frame rails 16', 17', 18' and 19' of these bed sections 16, 17, 18 and 19 may be made of any suitable metal shaped, for example as square tubing or as an angle iron. In the preferred embodiment the rails are made from square cross-section tubing.

The side frame rails 16' of the head section are formed integrally with and connected by a transverse head rail 23. The side frame rails 17' and 18' of the body section 17 and the intermediate section 18 are interconnected by downwardly offset transverse cross-tie rails 24 and 25. The side rails 19' of the foot section 19 are formed integrally with and interconnected by a transverse foot rail 26. The bed frame 15 is supported in the horizontal or bed configuration illustrated in FIG. 1 by a pair of foldable legs 27, each of which is generally U-shaped having vertical legs interconnected by a transverse bar section. The upper ends of the vertical sections of each leg are pivotally connected to the bed frame such that the legs may be folded beneath and parallel to the foot section and body section of the frame by means of the linkage system 13 when the bed frame is folded into the wooden frame of the sofa.

A mattress supporting deck 28 extends between and is supported from the side rails and end rails of the frame 15. This all cloth deck comprises a front deck section 30, sometimes referred to as the seat deck section, and a rear cloth deck section 40, sometimes referred to as the body deck section. These two sections are sewn together in the manner described hereinbelow so as to form an integral all cloth fabric deck. This all cloth fabric deck is manufactured from woven polypropylene fibers. The decks are cut so that the fibers of woven polypropylene which run in the fill direction of the fabric extend longitudinally of the fixture frame or between the end rails 23 and 26 as indicated by the arrow A in FIG. 2. The warp fibers of the woven polypropylene fabric extend transversely of the deck between the side rails as indicated by the arrow B in FIG. 2. The direction of the warp and fill fibers of the cloth is important to the practice of this invention as explained more fully hereinafter.

Figures 4, 5:
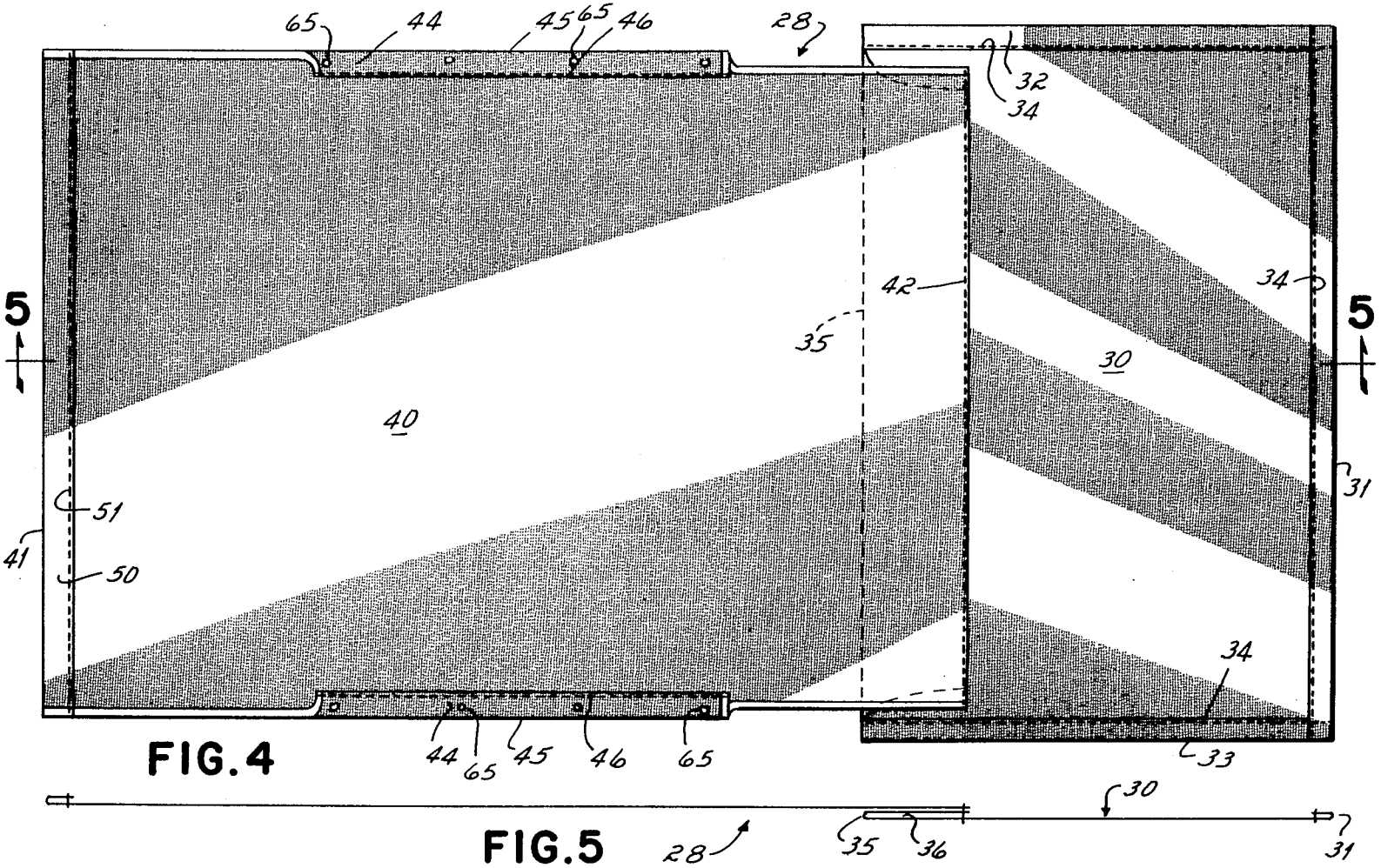
FIG. 4 is a top plan view of the sofa sleeper deck of FIG. 1.
FIG. 5 is a cross-sectional view taken on line 5—5 of FIG. 4.

With reference now to FIGS. 4 and 5, the front or leading edge 31 and side edges 32, 33 of the front section 30 of the deck 28 are overlapped or doubled over upon themselves to form a double thickness edge which is then sewn by double stitching as indicated at 34. As best seen in FIG. 5, the rear edge of the front section of the deck 30 is doubled over upon itself as indicated at 35 to form a rear pocket 36. The doubled over rear edge is then sewn to the leading edge 41 of the rear deck section 40 by double stitching 42.

The sides of the body section of the deck 40 are formed with a flap 44 extending from the central portion thereof. These flaps 44 are then folded over upon themselves to form a reinforced center section 45 medially of the length of the side edges of the rear section or body section of the deck. When doubled over upon themselves, the flaps are sewn together again by double thickness stitch lines 46.

The rear edge of the deck is also folded over or doubled over upon itself as indicated at 50 and then sewn together by double stitching 51 so as to form a double thickness rear edge on the rear deck section 40.

Again, with reference to FIG. 4, it will be seen that the front section 30 of the deck is wider in the transverse direction than the rear section 40 of the deck. The purpose of this additional width on the front section or seat section of the deck is to enable the sidemost edges of the front section of the deck to cover and hide the linkage system 13 of the sofa sleeper when the fixture is folded into the hollow interior of the sofa sleeper frame.

With reference now to FIGS. 1 and 2, it will be seen that the leading edge 31 of the front section 30 of the deck is connected by a plurality of helical springs 56 to the front crossbar 26 of the bed frame 15. In the preferred embodiment there are eight helical springs 56 spaced across the width of the front section of the deck connecting it to the front crossbar 26 of the frame 15. These springs enable the deck to be tensioned relative to the frame, and when the frame is folded into the wooden sofa frame, to tension the seating surface of the sofa upon which the sofa cushions rest.

The rear edge 50 of the rear deck section 40 is, in the preferred embodiment, connected to the rear crossbar 23 of the frame 15 by wire connectors 57. These connectors 57, of which there are eight in the preferred embodiment, each have a hook formed on their opposite ends. One end hook extends through a hole in the double thickness reinforced rear edge 50 of the deck 28, and the opposite end hook fits into a hole in the rear crossbar 23. In the preferred embodiment, wire hooks are used in lieu of helical springs similar to the springs 56 used to connect the front edge of the deck to the front crossbar. Helical springs could as well, though, be used to connect the rear of the deck 28 to the rear crossbar.

In accordance with the invention of this application, the reinforced side edges of the rear section of the deck 28 are directly attached to the side rails 17′ of the body section 17 of the frame 15 by wire clips 60. Prior to this invention, it has been the practice, as illustrated in U.S. Pat. No. 4,176,414 or U.S. Pat. No. 4,236,260, to connect the side edges of the rear section or body support section of the woven polypropylene deck to the side rails 17′ by means of helical springs. These springs were required in order to accommodate a gap which existed between the side edges of the rear section of the deck and the side rails of the frame while still maintaining the deck taut in the transverse direction. There is generally a tolerance of approximately one-quarter inch in the width of the frame of a bed and another one-quarter inch tolerance in the width of the deck. Consequently, there can be as much as one-half inch variance in the gap or distance between the side rails of the frame and the edge of the rear section of the deck from one sofa sleeper fixture to another. To accommodate that manufacturing variance, while still maintaining all of the decks taut on the frame, the helical springs, as shown in U.S. Pat. Nos. 4,176,414 and 4,236,260, were utilized to make the connection between the side rails of the frame and the side edges of the deck in the body support section of the frame.

According to the practice of this invention, the outside edge of the frames 15 are manufactured at least one-quarter inch wider than the combined width of the rear deck section and the width W of the clips 60. Thus, the deck must be stretched at least one-quarter inch and possibly as much as three-quarters inch in order to enable it to be attached by means of the clips 60 to the side rails 17′ in the body support section of the frame. Otherwise expressed, the deck must be stretched anywhere from one-quarter to three-quarters inch in the transverse direction in order to make this connection. To enable the hooks to make this connection, holes 62 are provided in the outside wall of the side rails for reception of inwardly turned upper end ears 63 of the hooks 60. The lower curved ends 64 of the hooks 60 extend through holes 65 in the double thickness side flaps 44 of the deck.

Prior to this invention, woven polypropylene fabric decks, such as decks manufactured by Belton Industries, Inc. of Belton, S.C., or other manufacturers of woven polypropylene fabric, were physically capable of being stretched to accommodate a gap from one-quarter to three-quarters inch, but the force and time required to impact that stretch to the deck were so great as to make it impractical to connect the body support section of the deck to the side rails in this way. Consequently, prior art deck materials were connected to the side rails by means of helical springs which functioned to take up slack between the side rail and the edge of the deck while maintaining the decks taut and wrinkle free. In the absence of the helical springs and with as much as one-quarter to three-quarters inch manufacturing variance in the gap between the side rails and the edges of the prior art deck material, a workman could not, as a practical matter, stretch the smallest prior art decks enough to take up the one-quarter to three-fourths inch for securement of the deck to the side rails.

In order to overcome this problem of either having wrinkles in the deck in the transverse direction between the side rails of the deck, or of having the deck require too great a force for manual stretching of it to accommodate manufacturing tolerances, the invention of this application incorporates a woven polypropylene deck which has increased stretch imparted to it in the warp direction. Persons skilled in the art of manufacturing woven polypropylene fabrics will readily appreciate that this additional stretch may be imparted to the fabric by adjusting the polypropylene sheet extruder to impart the necessary degree of stretch to the fabric in the warp direction. This is accomplished by controlling the parameters of the extrusion machine during the polypropylene sheet extrusion before the sheet is slit into fibers. One fabric suitable for its stretch fabric of this degree is manufactured by Belton Industries, Inc. of Belton, S.C. and is identified as their Style No. 723 fabric.

By a process of empirical testing, it has been found that a fabric which has the proper degree of stretch in the warp direction in order to accommodate direct attachment of the fabric to the frame in a stretched and taut condition without the presence of springs or resilient connectors therebetween is a fabric which stretches approximately 0.1 inches when a maximum pull of approximately 30 pounds is applied over 0.3 seconds to a specimen which measures 10 inches in the length direction and 3 inches in the width direction. This degree of stretchability of a fabric deck has been found to be satisfactory for direct attachment by means of a non-elastic connector to the side rails of the frame 15.

Figure 6:
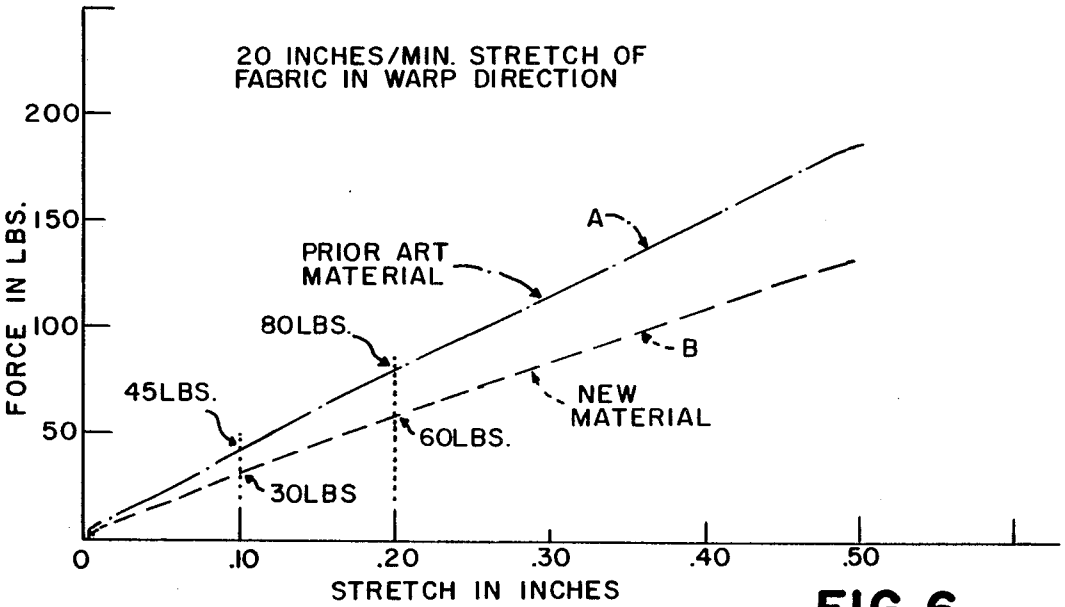
FIG. 6 is a force to elongation curve characteristic of the woven polypropylene material of which the deck of FIG. 2 is made in accordance with the invention of this application.

One machine for testing for this degree of stretchability of the fabric is a Scott CRE-500 tester having a digital and graphic readout. With reference now to FIG. 6, there is illustrated plots generated on a Scott CRE-500 machine by conventional prior art woven polypropylene deck material (curve A) and by the new deck material made in accordance with the practice of this invention (curve B). As may be seen in FIG. 6, the prior art deck material requires approximately 45 pounds of pull to stretch a 3-inch wide×10-inch long strip of prior art fabric 0.1 inches in the length (warp) direction when the force to stretch the material is applied for 0.3 seconds. (0.1 inches of stretch over 10 inches of length translates into 0.5 inches over a 50-inch long sample which approximates the width of a bed.) The more stretchable new material (curve B), according to the practice of this invention, on the other hand, requires approximately 30 pounds of force to accomplish the same degree of stretch in the same period of time. Material of this new stretchability (curve B) has been determined to be acceptable for manual stretching of the deck to enable it to be connected directly to the side rails manually without the operator becoming overly fatigued or unable to make the connection. Material of the former stretchability, curve A in FIG. 6, has been found, though, to be impractical from a production standpoint for attachment without the presence of springs because of workmen becoming fatigued and unable to repeatedly make the connection.

The advantage of the invention of this application, which incorporates a more stretchable deck material in the warp direction than prior art woven polypropylene decks and which connects that deck material directly to the side rails of the bed frame in the body support section of the frame without the presence of resilient connectors is that the resulting sofa sleeper is much less subject to sag than prior art sofa sleepers which incorporated a less stretchable woven polyropylene fabric in the warp direction, but which then required that less stretchable deck material to be attached to the side rails of the frame in the body support section of the frame by means of helical resilient connectors.

While I have described only a single preferred embodiment of my invention, persons skilled in this art will appreciate changes and modifications which may be made without departing from the spirit of my invention. Therefore, I do not intend to be limited except by the scope of the following appended claims.

I claim:

1. A foldable sofa sleeper fixture for supporting a bedding mattress in a flat planar condition when unfolded and for containing the mattress in a folded condition within a sofa sleeper frame when folded, which fixture comprises:

a generally rectangular metal frame comprising at least a head, a body, and a foot section, said sections being pivotally connected one to the other so as to enable said sections to be unfolded into a flat planar condition or folded into a generally U-shaped configuration with said foot section overlying said body section, said foot section of said frame comprising a pair of side frame members interconnected by an end frame member, said body section of said frame comprising a pair of side frame members, said head section of said frame comprising a pair of side frame members interconnected by an end frame member, and an all cloth deck made from woven polyproplene fabric material extending transversely between said side frame members and longitudinally between said end members, said all cloth deck being connected to said side frame members of said body section of said frame solely by non - elastic connection without the presence of any resilient connectors therebetween.

2. The sofa sleeper of claim 1 wherein said woven polypropylene fabric is characterized by a force to elongation stretch curve in the transverse direction as depicted in curve B of the chart illustrated in FIG. 6 hereof.

3. The sofa sleeper fixture of claim 1 wherein said woven polypropylene fabric is characterized in the warp direction by a 10-inch long×3-inch wide specimen of fabric being stretchable for approximately 0.1 inch in 0.3 seconds in the length direction when a force of 30 pounds is applied thereto.

4. The sofa sleeper of claim 1 wherein said woven polyproplylene fabric is characterized in the warp direction by a 10-inch long by 3-inch wide specimen of fabric requiring a force of approximately 30 pounds in order to stretch the fabric in the length direction 0.1 inch in 0.3 seconds.

5. The foldable sofa sleeper fixture of claim 1 in which said all cloth deck is connected to at least one of said end members by means of a plurality of resilient connectors.

6. The sofa sleeper fixture of claim 5 wherein said resilient connectors comprise a plurality of helical tension springs.

7. The sofa sleeper frame of claim 1 in which said rectangular frame further comprises an intermediate section located between and pivotally connected to said foot section and said body section.

8. A foldable sofa sleeper fixture for supporting a bedding mattress in a flat planar condition when unfolded and for containing the mattress in a folded condition within a sofa sleeper frame when folded, which fixture comprises:

a generally rectangular metal frame comprising at least a head, a body, and a foot section, said sections being pivotally connected one to the other so as to enable said sections to be unfolded into a flat planar condition or folded into a generally U-shaped configuration with said foot section overlying said body section, said foot section of said frame comprising a pair of side frame members interconnected by an end frame member, said body section of said frame comprising a pair of side frame members, said head section of said frame comprising a pair of side frame members interconnected by an end frame member, an all cloth deck made from woven polypropylene fabric material extending transversely between said side frame members and longitudinally between said end members, and non-elastic means only connecting said all cloth deck to said side frame members of said body section of said frame without any spring connectors located between and connecting said all cloth deck to said side frame members of said body section.

9. The sofa sleeper fixture of claim 8 wherein said woven polypropylene fabric is characterized by a force to elongation stretch curve in the transverse direction as depicted in curve B of the chart illustrated in FIG. 6 hereof.

10. The sofa sleeper fixture of claim 8 which further comprises an intermediate section located between and pivotally connected to said foot sections and said body sections of said metal frame.

* * * * *